US007951044B1

(12) United States Patent
Burks

(10) Patent No.: US 7,951,044 B1
(45) Date of Patent: May 31, 2011

(54) EXERCISE ROUTINE DISPLAY SYSTEM AND METHOD

(76) Inventor: John H. Burks, Lynchburg, VA (US)

( * ) Notice: Subject to any disclaimer, the term of this patent is extended or adjusted under 35 U.S.C. 154(b) by 1352 days.

(21) Appl. No.: 11/288,628

(22) Filed: Nov. 29, 2005

(51) Int. Cl.

| | |
|---|---|
| ***A63B 15/02*** | (2006.01) |
| ***A63B 69/00*** | (2006.01) |
| ***A63B 71/00*** | (2006.01) |
| ***B09B 9/00*** | (2006.01) |

(52) U.S. Cl. ..... 482/1; 482/902; 434/247

(58) Field of Classification Search ..... 482/1–9; 434/247–255, 257; 715/700, 961
See application file for complete search history.

(56) References Cited

U.S. PATENT DOCUMENTS

| | | | |
|---|---|---|---|
| 5,462,503 | A | 10/1995 | Benjamin |
| 5,466,200 | A | 11/1995 | Ulrich |
| 5,598,849 | A | 2/1997 | Browne |
| 5,785,630 | A | 7/1998 | Bobick |
| 5,836,770 | A | 11/1998 | Powers |
| 5,890,995 | A | 4/1999 | Bobick |
| 5,890,997 | A | 4/1999 | Roth |
| 6,152,856 | A | 11/2000 | Studor |
| 6,336,891 | B1 | 1/2002 | Fedrigon |
| 6,669,600 | B2 | 12/2003 | Warner |
| 6,852,068 | B2 | 2/2005 | Ogawa |
| 2002/0082143 | A1 | 6/2002 | Leeds |
| 2003/0134718 | A1 * | 7/2003 | Kim ..... 482/54 |
| 2005/0209050 | A1 * | 9/2005 | Bartels ..... 482/8 |

* cited by examiner

*Primary Examiner* — Loan Thanh
*Assistant Examiner* — Oren Ginsberg
(74) *Attorney, Agent, or Firm* — Denis R. O'Brien

(57) ABSTRACT

The present invention is an exercise routine (ER) display system and method that can substitute as a trainer/therapist for the purpose of leading one or more users through a single exercise task or through an entire ER. The device displays a predetermined series of exercise tasks seriatim in a predetermined sequence, displaying each repetition of each task in the proper cadence according to a set of variable parameters that specify how each maneuver is to be displayed. Audible elements of the display count the repetitions or give cues for proper technique. Various other types of information are shown visually. The exercise maneuvers are displayed on a local display module that includes, in one embodiment, data processing components, data input/output components, display components, and sufficient long-term memory capacity to accommodate a large library of exercise maneuvers. In a second preferred embodiment, the memory capacity of the local display module is minimal, and ER data are provided to the module in an ad hoc fashion through a data input means such as CD-ROM, DVD, flash memory, or through a USB, wireless, or Internet connection to a master computer.

20 Claims, 3 Drawing Sheets

EXERCISE ROUTINE DISPLAY SYSTEM AND METHOD

CROSS-REFERENCE TO RELATED APPLICATIONS

Not applicable.

FEDERALLY FUNDED RESEARCH

Not applicable.

SEQUENCE LISTING OR PROGRAM

Not applicable.

BACKGROUND OF THE INVENTION

1. Field of the Invention

The field of my invention is display devices for displaying exercise routines.

2. Statement of the Problems Solved by the Invention

Every year hundreds of thousands of unfit individuals finally decide that it is time to get off the couch and get back in shape. And every month thousands of recuperating accident victims and patients recovering from disease commence physical therapy or occupational therapy programs in order to speed rehabilitation and facilitate recovery. The vast majority of such individuals are not trained athletes, and for them remembering a sequence of exercise tasks in a workout routine and the proper techniques for performing each task of a routine can be a real challenge. Also, individuals who are not trained athletes often have a hard time focusing on their workouts and, consequently, they are easily interrupted and lose track of how may repetitions of an exercise task they have completed, or which tasks have been completed. Even trained athletes can become bored or distracted during lengthy workout sessions, thereby losing concentration and adversely affecting the quality and results of the workout. In addition, there is a growing emphasis in fitness in school children, but they, too, are easily distracted.

For these reasons, trainers and therapists are often employed to lead individuals through exercise workouts, either individually or in small groups. Unfortunately, hiring a trainer/therapist can be too expensive for many individuals; consequently, many individuals who need exercise but who cannot afford a personal trainer/therapist relapse into their corpulent ways or forego beneficial physical therapy.

Another problem encountered by individuals wanting to exercise regularly is that such individuals frequently do not have access to video equipment for playing video exercise demonstration tapes they come to rely on. For instance, individuals on vacation or traveling on business, even if they do carry an exercise video tape with them, find it time-consuming and difficult to find a video system with which to play their exercise video. Therefore, they can easily miss days of exercise and lose ground.

What is needed to overcome these problems is a portable, durable stand-alone exercise routine display system that can be used in any environment, at any time, and wherever the user desires, and that presents personalized workouts to the user, thereby, in effect, substituting as a personal trainer/therapist. Such a device should not just present a video-taped demonstration of an exercise task or a sequence of exercise tasks, it should also be capable of guiding the user through an exercise routine by keeping track of repetitions and maintaining a proper cadence, just as a trainer does. Such a device should have sufficient plasticity that it can display a large number of exercise tasks, including each repetition of each task performed in the proper cadence, and it should display helpful status information such as a timer, the total number of repetitions comprising the task, and the current repetition. In addition, such a device should permit the user to skip, repeat, or return to any exercise task in a routine.

3. Related Art

The art of video demonstrations of exercise routines is old and well-known. For decades body-builders, trainer/therapists, and even movie stars have produced exercise videos for the mass market intended to lead a person through exercise tasks in the privacy of the user's own home. Such mass-produced videos, however, fail to solve the problems described above because the choice of tasks, sequence of tasks, number of repetitions, and cadence are fixed and cannot be personalized to meet the individual user's needs and abilities. Furthermore, such videos require cumbersome video equipment to display the exercise routines.

One common approach to more personalized exercise videos is what may be referred to as "user-driven" video approach. An example of such a user-driven approach is found in U.S. Pat. No. 6,852,068 to Ogawa, which displays cartoon images representing reeling in a big fish at a rate proportionate to changes in the user's heart-lung function while peddling a bicycle-like device. With this approach, it is the user's rate of exercise that drives the video display or otherwise modifies the video display. Such devices, while popular and effective, are not helpful in solving the problems discussed above because the video display "follows" the user rather than "leads" him/her through the exercise routine.

U.S. Pat. No. 5,836,770 to Powers is representative of a low-level "display-driven" approach to video-based training. Powers discloses recording an exercise task from a plurality of angles simultaneously and then presenting all of the views of the task on a split-screen display monitor such that all of the angles are displayed in synchrony. Powers thus allows the user to see each exercise task being properly performed from, for instance, both the front and the back, and the user follows along as the exercises are performed. While this approach may be considered display-driven, it is rudimentary in the sense that the tasks are presented in a fixed sequence and are not adaptable in terms of, for instance, repetition numbers and cadence in order to meet a given user's needs and requirements.

U.S. patent application Ser. No. 09/360,225 of Leeds, now abandoned, discloses a display-driven method for creating customized exercise routines and, hence, represents a higher-level display-driven approach. Leeds discloses producing personalized visual presentations of exercise routines in a digital format by compiling the routines from Internet-accessible digital archives of exercise excerpts wherein the excerpts are categorized according to broad performance capabilities.

Although the Leeds disclosure is insightful with respect to the value of digital libraries of exercise excerpts for producing exercise routines, none of the existing art, including Leeds, discloses a solution to the problem of how to present pre-programmed exercise routines to a user in a manner in which each of the tasks is personalized to meet that specific user's needs. Nor does the existing art teach a system that guides the user through her/his routine by demonstrating each repetition of each task at a cadence that is appropriate to the user's needs, or that empowers the user to modify an exercise routine in real-time. Nor does the existing art disclose a portable, durable stand-alone exercise routine display device.

Clearly, the existing art does not fulfill the functional and structural criteria of a personalized exercise routine display system required to overcome the many problems discussed herein above.

BRIEF SUMMARY OF THE INVENTION

An exercise routine ("ER") as the term is used herein is a sequence of exercise tasks to be performed seriatim. The present invention is an exercise routine display system and method that can substitute as a trainer/therapist for the purpose of leading one or more users through a single exercise task or through an entire ER. The device displays a predetermined series of exercise tasks seriatim in a predetermined sequence, displaying each repetition of each task in the proper cadence according to a set of variable parameters that specify how each maneuver is to be displayed. Audible elements of the display count the repetitions or give cues for proper technique. Various other types of information are shown visually. The exercise maneuvers are displayed on a local display module that includes, in one embodiment, data storage components, data processing components, data input/output components and display components.

One embodiment of the system comprises a local display module with sufficient long-term memory capacity to accommodate a large library of exercise maneuvers. In a second preferred embodiment, the memory capacity of the local display module is minimal, and ER data are provided to the module in an ad hoc fashion through a data input means such as CD-ROM, DVD, flash memory, or through a USB, wireless, or Internet connection to a master computer.

Each exercise task in the ER represents an exercise maneuver encoded in graphics data. Associated control data define or specify the task parameters for displaying the task. All of the selected graphics data and their associated control data comprise the exercise routine data, or ER data, which are complied into an ER data file. In a preferred embodiment, this ER data file is produced on a master computer and transferred to a local display module that displays the ER. The user accesses the ER data at run-time in order to display each of the chosen exercise tasks seriatim. In one preferred embodiment the ER is displayed by displaying for each task 1) an animated figure performing each repetition of the task's maneuver, 2) an alphanumeric identifier of the exercise task being displayed, 3) an alphanumeric and/or audio indicator of the present repetition, 4) an alphanumeric indicator of the total repetitions to be performed, 5) an alphanumeric indicator of the cadence of the present task, and 6) an alphanumeric user identifier.

Even though a given ER is pre-programmed, the user has a certain degree of control over her ER during run-time. For instance, the user may choose to skip tasks in a routine, modify the cadence or the number of required repetitions, or fast-forward/reverse through a routine to reach a specific task. These modifications may be made by user input controls located on the local display monitor or via a wireless remote control.

My invention also includes a data-logging function to obtain, store, and transmit data regarding the user's workouts and thereby permit the trainer/therapist to follow the user's progress.

One general object of my invention is to provide an ER display device that is capable of displaying an ER to a user wherein the ER display includes displaying each repetition of each exercise task comprising the ER.

Another general object of my invention is to provide an ER display device that can accept as input a plurality of parameters describing a desired ER and that can display that ER on demand.

Another general object of my invention is to provide an ER display device that is capable of substantially substituting for a trainer/therapist in guiding a user through an ER.

Another general object of my invention is to provide an ER display device that can be programmed to display specific, distinct ERs based on the current needs of a user or based on a plurality of needs of a plurality of users.

Another general object of my invention is to provide an ER display device that presents an ER that can be modified or adapted by the user at run-time.

Another general object of my invention is to proved an ER display device that is capable of creating, storing, and transmitting performance data relevant to a specific users use of the device.

Accordingly, an ER display device is disclosed and claimed that meets the foregoing objects and that solves the problems discussed herein above.

BRIEF DESCRIPTION OF THE DRAWINGS

In the drawings identical reference numbers are employed to identify identical elements. The sizes and relative positions of the elements in the drawings are not necessarily to scale. For example, thicknesses are not drawn to scale and are enlarged to insure comprehension of the drawings.

DETAILED DESCRIPTION OF THE INVENTION

Figure 1:
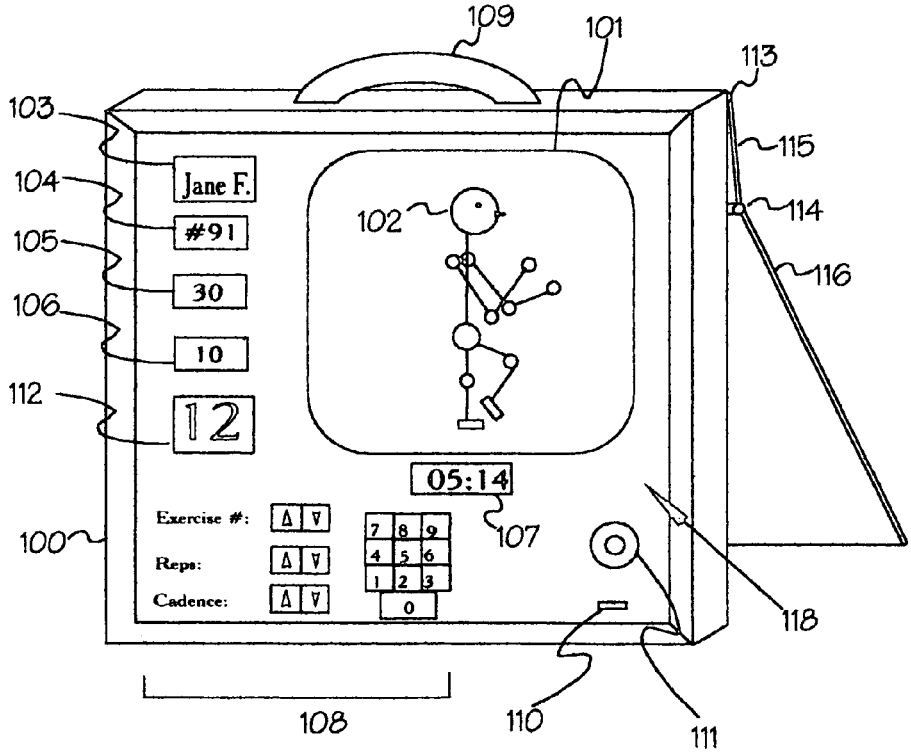
FIG. 1 is a front isometric view of a preferred embodiment of my invention.

The inventive concepts and novel features of my invention are now described with reference to specific embodiments, which embodiments collectively represent the best mode known to me for making and using the invention. The elements of the invention and their structural and functional relationships may be easily comprehended by referring to this specification together with the figures; however, it is to be noted that the embodiments described herein are representative of many possible embodiments that incorporate the inventive concepts of my invention. All of the electronic components that are combined to produce my invention are well known in the art and no claim is made to the architecture or functional capabilities of any single electronic component. Given the disclosures made herein, one skilled in the art of electronics will be able, without undue experimentation, identify and assemble the necessary components in order to produce and use my novel ER display device.

1. Meaning, Scope, and/or Usage of Certain Terms

The following lexicon sets forth the intended scope and meaning of certain terms and concepts used in the present specification and claims. The definitions set forth below include singular, plural, and grammatical variations of the terms defined unless otherwise noted. Examples are provided in order to facilitate an understanding of the definitions and are not intended to limit definitions.

Display: 1. n. Visual and/or audio output presented to a user. 2. n. Components required to produce visual and/or audio output to a user. Such components include, without limitation, audio/visual processors and drivers, speakers, and monitors or screens. 3. v. The act or process of producing video and/or audio output to a user, including processing the necessary graphics and/or audio data.

Maneuver: A single repetition of a movement or combination of movements that is or is intended to be performed by a user. For instance, a single push-up is a combination of movements of the type referred to herein as a maneuver.

Repetition: 1. A quantitative statement of the number of times a maneuver has been or is intended to be repeated. 2. A single, fully completed maneuver.

Task parameters: A set of values that identifies a task and specifies how its maneuver is to be displayed. Task parameters may include, without limitation: task identifier, total repetitions of the maneuver to be displayed, remaining repetitions to be performed, pause-time between repetitions, cadence, hold-time, task duration, task rate, and amount of weight to be used.

Exercise task, or task: A maneuver that is carried out or is intended to be carried out according to one or more "task parameters". A push-up repeated 15 times at a cadence of 30 per minute would represent an exercise task.

Exercise routine (ER): One or more exercise tasks to be performed in a specified sequence during a workout.

Routine parameters. A set of values that specifies how an ER is to be displayed. Routine parameters may include, without limitation: user identifier, exercise tasks to be displayed, exercise task display sequence, inter-task pause time, and total routine duration.

User: A person or group of persons who use the invention to workout.

Run-time: Refers to the period of time during which a user is using the invention to display an exercise routine.

Trainer/therapist: A person or group of persons who design, create, and/or manage ERs that are to be performed by a user. The term is used broadly to include those who carry out evaluations of a user to generate the information required to create a personalized ER for the user.

Local: Refers to the elements, components, operations and functions that are a part of or carried out by the display that displays the ER to a user during run-time, as opposed to the elements, components, operations and functions that are part of or carried out by a separate master computer or other distinct device, which master computer or other distinct device may, for instance, be used to design, create, store, and/or produce ER's.

Exercise routine data (ER data): Data required to fully encode an ER for displaying. ER data comprise, at a minimum, control data and graphics data.

Graphics data: ER data that encode the visual representations of maneuvers. Such graphics data include, but are not limited to, data formatted as JPG, AVI, MOV, MPEG, and DVD files. The invention is not limited by the source or type of graphics data, and the graphics data format will be determined by the type of visual display apparatus used to display the ER.

Control data: ER data used to specify how a maneuver and/or routine is to be displayed. Control data encode, without limitation, task parameters and routine parameters, and may include audio data representing such parameters for audio display.

Performance data: Data that encode present and/or past performance of a user when using the invention.

Data processor: Includes both hardware and software necessary to produce, edit, display, and store graphics data, performance data, and/or control data. Unless otherwise indicated, the term is used to include short-term, volatile memory (e.g. RAM) required in the processing of data.

Data storage media: The term is used as in the normal parlance of the art to include all computer-accessible data storage media and their associated read/write devices, together with the program instructions necessary to read data from and write data to the device. Examples of data storage media include, without limitation, CD, CD-ROM, DVD, flash memory, floppy-drive, and hard drive devices.

2. Structural Features

Figure 2:
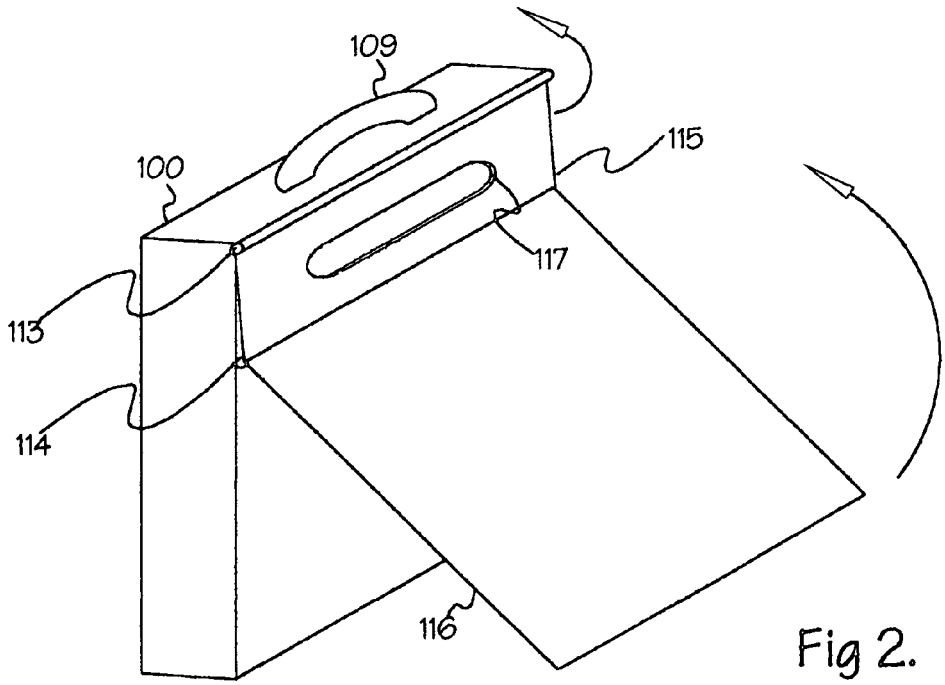
FIG. 2 is a rear isometric view of the same embodiment shown in FIG. 1.

Referring first to FIGS. 1 and 2, it will be seen that my invention comprises a cabinet 100 for enclosing and protecting a plurality of display screens and the other components of the invention. To the cabinet is connected carrying handle 109.

A maneuver display screen 101 is provided that is sufficiently large to display an animated or video demonstration of the maneuver being performed. In FIG. 1, the maneuver is demonstrated by means of a cartoon animation 102 such as a stick-figure. However, the scope of my invention includes any type of video representation that is amenable to being encoded in graphics data.

The display area also includes means for displaying various types of information of interest to the user. This may be accomplished by separate task parameter and/or routine parameter displays, such as separate LCD screens, as shown in FIG. 1, or partitions of the main exercise display screen in to separate areas. The user's name or other identifying means is shown in user ID screen 103. This is particularly helpful in situations in which a number of the devices are mounted on a wall in a matrix or an array and are used simultaneously by different users. The user ID screen allows a user to quickly identify the relevant device.

Task ID screen 104 displays an alphanumeric identifier of the task presently being performed. Total repetition screen 105 displays the total repetitions required for the task currently being performed, and current repetition screen 112 displays the current repetition being demonstrated in the exercise display screen. Alternatively, or in addition, to displaying the present repetition, a count-down display of the number of repetitions remaining can be displayed. Cadence screen 106 displays the cadence for the current task. Count-down timer screen 107 shows a count-down timer that informs the user how much time is left in the present workout.

An audio output device such as speaker 111 and/or ear phone jack (not shown) is provided to allow exercise cues, instructions, or status information such as the repetition count to be transmitted audibly to the user.

In one preferred embodiment, the device includes a user control interface 108. This interface is used to acquire the user's preferences for modifying control data such as the exercise task to be performed, the number of repetitions, or the cadence. FIG. 1. shows the user control interface as pressure-based keys and a keypad, as are commonly used in computer devices.

The various components and functions of my invention may be partitioned between two or more physically separate entities, such as a local display module and a master computer. The local display module may incorporate just a display device and little or no data storage or processing capacity. Conversely, the local display module may have significant data storage and processing capability in addition to display capabilities. The embodiment of the invention shown in FIG. 1 includes a USB-based data transfer interface 110 that can be used to transfer data to (upload) and/or from (download) an external master computer or other data source. CD-ROM, DVD, flash memory devices, and various wireless devices that are well known in the art are suitable data transfer mechanisms for my invention.

Figure 3:
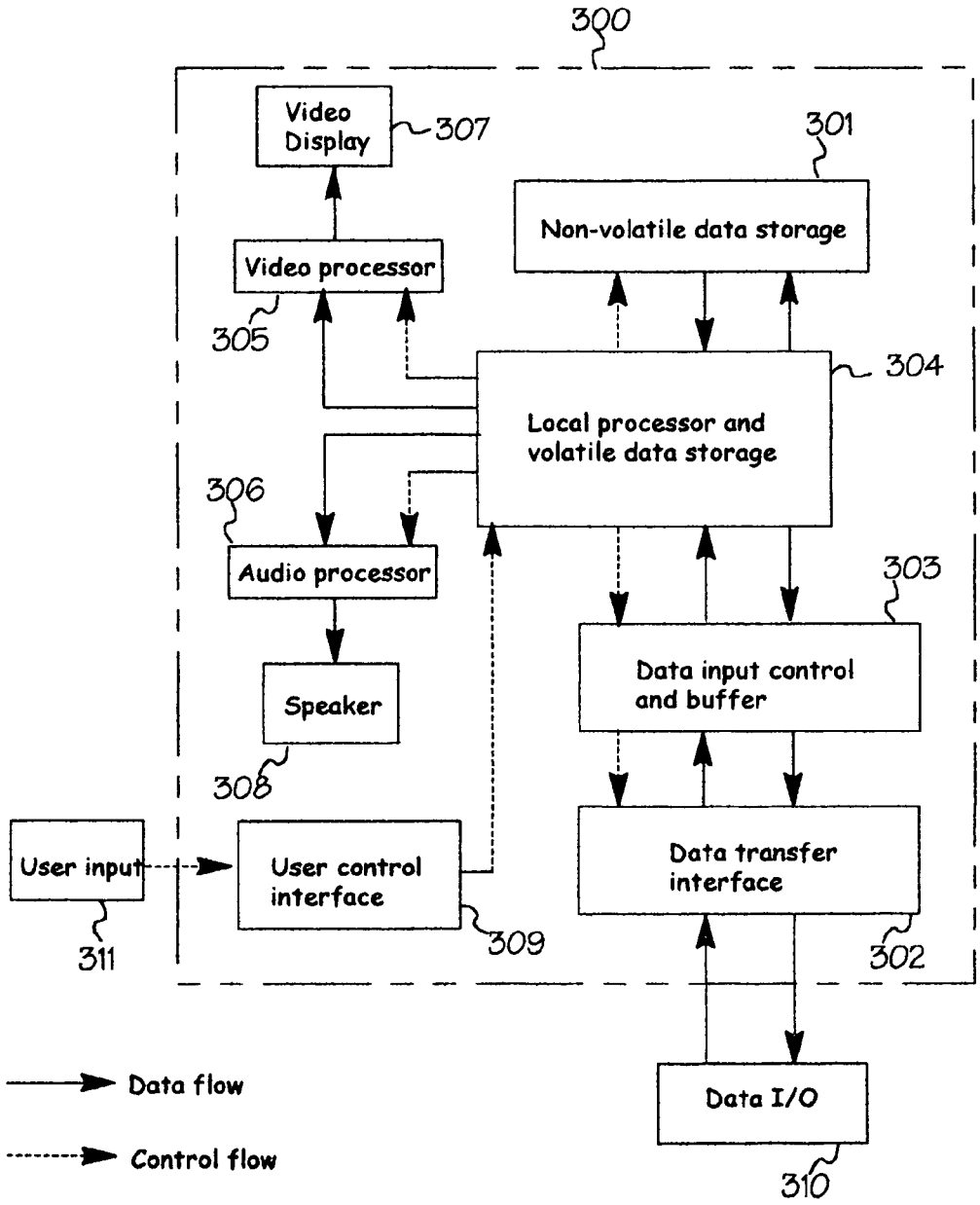
FIG. 3 is a flow diagram representing the data and control flow amongst the major components of a local display module of a preferred embodiment of my invention.

FIG. 3. is a schematic of the data and control flow among the components of a local display module 300 of a preferred embodiment of the invention. A local data storage device 301 is provided for long term, non-volatile data storage. A data transfer interface 302 and a data input control means and buffer 303 are provided. As disclosed above, CD-ROM, DVD, and USB-based devices are examples of the types of currently available data transfer interfaces that can be used to transfer data to and from the module. As data transfer technologies advance, new data handling means not now known will become available and will become obvious as ways to implement the data transfer functions of my invention.

A local processor and short-term, volatile memory 304 are provided. These functions may be combined in one physical component, as shown, in separate components, or as part of multi-functional components incorporating a video processor 305 and/or an audio processor 306. Output to video display 307 is controlled by the video processor and output to speaker 308 is controlled by the audio processor.

A user control interface 309 provides a means for the user to modify control data at run-time.

3. Functional Features

Figure 4:
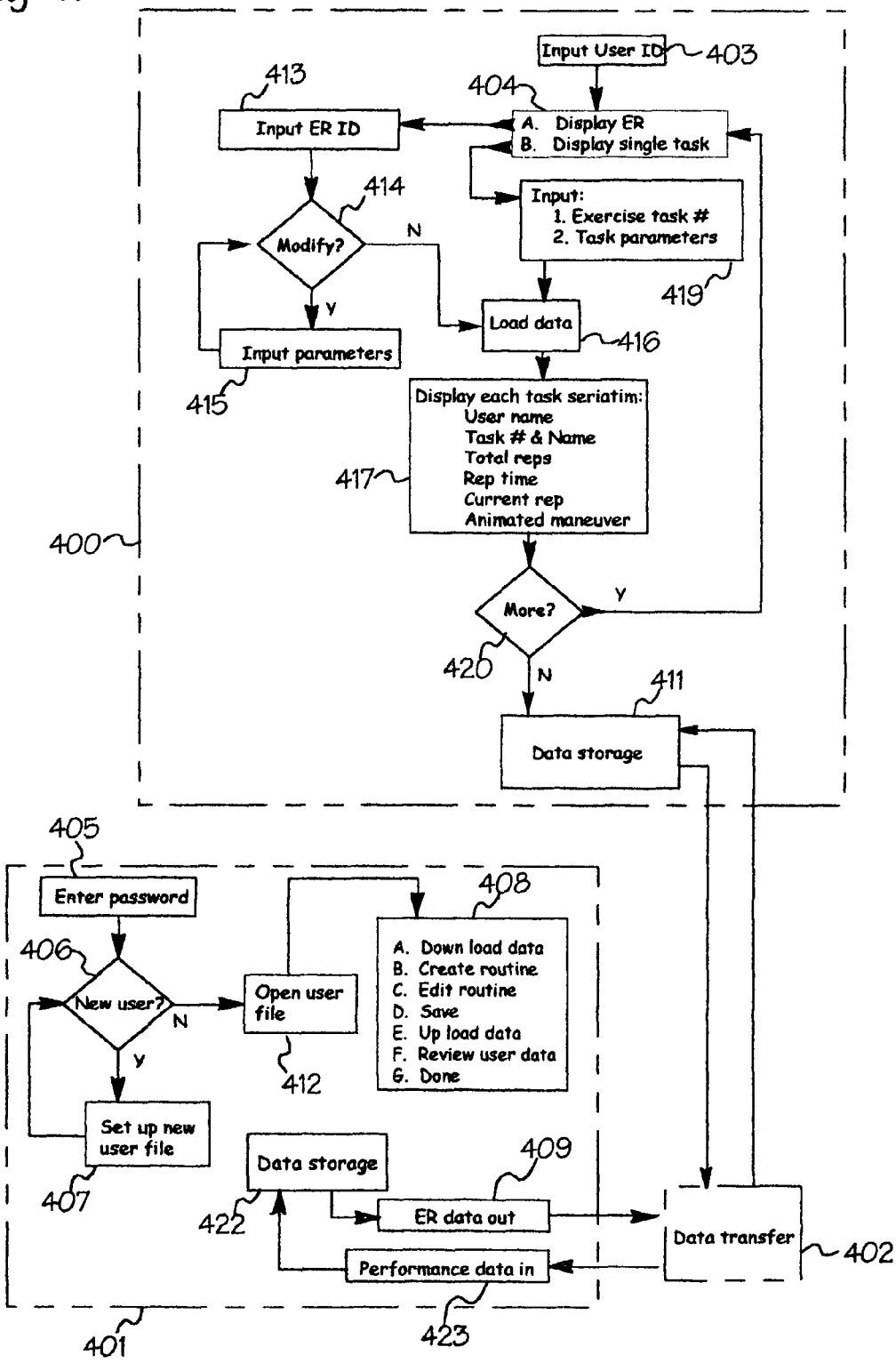
FIG. 4 is a flow diagram of a preferred embodiment of the control-flow for effectuating the operation of my invention.

The functional features and relationships between the various components may be understood by referring to FIG. 3 and FIG. 4, which show data and control flows between the various components of my invention.

a. Data Structures

The present system produces, processes, and displays both generic ERs that are produced for a mass market and personalized ERs that are produced for individual users. The disclosures made herein emphasize the production and use of personalized ERs because that is were the major strength of my invention lies. In order to fully comprehend the way in which my invention functions, it is helpful to understand the various data structures produced and utilized by the preferred embodiment, which is a system comprising a stand-alone local display module, a master computer, and data transfer means for transferring data between the two. Although many different data structure designs will be obvious to those of skill in the art for carrying out the objects of my invention, a data structure preferred by me is disclosed here.

Exercise routine data (ER data) are those data necessary to display an ER using my system. ER data are conveniently organized into two types of data structure: graphics data and control data. An additional data structure, performance data, is, used to represent a user's past performance with the system. Performance data are not required to display an ER, but they are helpful in following a user's progress and in designing and modifying the user's ER.

ER data may be best conceptualized as a plurality of objects organized as an array of exercise tasks, with each exercise task being assigned to an element in the array according to the sequence in which the tasks are to be performed. Each element of the ER array represents an object (task) comprising graphics data (the maneuver) and control data (display parameters).

Performance data structures include historical data that describe a user's past interactions with the system. For instance, performance data include the dates of past workouts, the exercise tasks performed, and the numbers of repetitions of each exercise task performed. These performance data do not control or affect the manner in which a maneuver is displayed, but they can be used to track a user's progress and to create or modify ERs to reflect that progress.

The way in which the system uses these various data structures is now disclosed.

b. Using the System to Display an Er or Individual Tasks.

Turning to FIG. 4, the flow of data and control during the operation of my invention can be fully understood. Local display module 400 is a stand-alone display module used to display ERs to a user. The flow diagram elements inside 400 represent the functions and steps necessary to display an ER at run-time. A master computer, represented by 401, is physically separate from display module 400 in my preferred embodiment. The flow diagram inside 401 represents the functions and steps necessary to create and edit an ER. Whilst the preferred embodiment contemplates having a stand-alone local display module distinct from the master computer, it is within the intended scope of the disclosure and claims that all of the functions and steps shown in FIG. 4 can be carried out within a single physical device.

The component designated 402 represents the elements required to achieve the necessary transfer of data between local device 400 and master computer 401. Commonly known options include CD, CD-ROM, CD/DVD readers, USB-type connections, flash-memories, and floppy-disk based data transfer. Wireless options for data transfer are also within the scope of the invention and are discussed below.

A workout directed by my invention begins with setting up the display module in a desired environment and turning on the power source (not shown.) Portable local display modules are sufficiently small and lightweight that they may be transported to any desirable venue for use, such as the users' home, office, therapy clinic, or even on vacation. Other types of local devices may be more-or-less permanently set up for use. For instance, a therapy clinic may have an array of display modules attached to a wall.

At 403 a user ID is input in order to gain access to the system. If the ID matches an entry in a database of user IDs, menu 404 appears and presents two choices.

If the user chooses option "A" provided by menu 404, an ER display is initiated. At 419 the user inputs an ER ID in order to call up the desired routine. If the trainer/therapist wishes to restrict certain routines to certain users, the device can be programmed to require that the ER ID maps to the users ID. Alternatively, the device can be easily configured such that each user has just one ER, therefore obviating the step of inputting a desired ER after inputting the user's ID.

At 414 the user is given the opportunity to modify the ER. If the user wishes to do so, she so indicates and is prompted 415 to input her preferences for new task and/or routine parameters by using the user input interface (e.g. 108 of FIG. 1). For instance, the user may wish to increase or decrease the number of repetitions for a given task or for a set of tasks, thereby over-riding the task parameters designated in the ER data. Such modifications of the ER can be carried out through a simple menu-driven approach using the user input interface.

At 416 ER data, including any modified task parameters, are loaded into the local processors short term memory for processing.

At 417 appropriate output from the local processor goes to the video and/or audio devices, referred to collectively herein as "display devices." For each exercise task in the routine, the display devices display the maneuver and various parameters, as shown in the example of FIG. 1. Foremost among the data displayed is, of course, the graphics representation/animation of the maneuver the user is supposed to perform. Each repetition of the maneuver is displayed at the proper cadence according to the control data. Task parameters and routine parameters are also displayed; for instance, the current repetition number, the user's name or other ID information, the current task name or number, the total repetitions to be performed for that task, the number of remaining repetitions to be performed, a value representing the cadence, and the amount of time remaining in the workout. These parameters may be displayed visually and/or audibly. The current repetition number is particularly amenable to audible display.

Once the current exercise task is completed, the device calls the next task specified by the control data. The workout thus displays, seriatim, all of the exercise tasks specified by the control data, with each repetition of each task presented according to the control data as specified by the trainer/therapist or as modified by the user. Once the ER is completed the user is directed 420 back to menu 404 if she wishes to continue working out. When the user is finished, a file containing the performance data is saved to a data storage device 411 pending uploading to the master computer for analysis.

From menu 404, the user may alternatively choose "B" in order to perform a single, specified exercise task rather than an entire routine. The user is then presented menu 419, which allows the user to input the ID of the task she wishes to perform as well as to modify task parameters. The chosen maneuver is then presented as a task, using the parameters supplied by the user. The ER data are loaded 416 into the short term memory of the processor for processing and display. The maneuver is then displayed 417 for as many repetitions as the user has indicated. Once the chosen task is completed, the user may choose 420 to proceed to another task or to quit. In this way, the user may build her own workout routine at run-time. Of course, the user's choice of tasks will be limited to the maneuvers stored on the local device's memory, unless the local device has the capabilities of uploading maneuvers from a master computer at run-time, as disclosed below.

c. Creating and Editing Routines.

Referring again to FIG. 4, master computer 401 is used by the trainer/therapist to produce ERs—either generic ER's for mass distribution or personalized ER's for specific users. These routines are organized as ER data files, described above, and are stored in the non-volatile memory 422 of the master computer.

The trainer/therapist first inputs a proper password 405 to gain access to the system. Then he indicates 406 whether he is designing an ER for an existing user or creating one for a new user. If it is a new user, a new user file is set up and initialized 407. At 412 the appropriate user file is opened for read/write operations. The trainer/therapist is then presented with menu 408 that displays the various available functions for creating and maintaining routines.

Graphics data for each maneuver are stored in a maneuver catalog in memory 422. The trainer/therapist builds the ER by choosing the desired maneuvers from the catalog of maneuvers stored on the master computer. For each maneuver chosen, the trainer/therapist enters the desired task parameters to populate the ER data variables. The tasks are arranged in the sequence in which they are to be performed by placing them in the appropriate element of the object array described above.

The type and number of task parameters that define each exercise task will depend on the specific maneuver. For instance, the task parameters defining a knee-lift task are 1) "RepNum," the number of repetitions to be performed; 2) "RepTime," the repetition duration in seconds, and 3) "PTime," the pause, the time between repetitions in seconds. The cadence (variable "Cadn"), given in repetitions per minute, is 60 divided by the sum of RepTime and PTime and can either be stored as a part of the ER data object or can be calculated at run-time. Cadence is generally modified by increasing or decreasing RepTime. A different set of variables defines, for instance, a stretch task employing a weight. They include "Wgt" the amount of weight, RepNum, RepTime, Cadn, "HoldTime," (the number of seconds a position is to be held) and PTime.

A separate set of variables stored in the ER data object are referred to as routine parameters. These parameters control the manner in which the ER will be displayed at run time. Examples of routine parameters include the total duration of the routine (which may be calculated either before run-time or during run-time), the tasks to be displayed, the sequence in which the tasks are to be displayed, and the inter-task pause time. Where access to an ER is restricted to specific users, routine parameters also include the ID data of users who may access the ER.

Once the user's ER has been designed by inputting the desired maneuvers and setting the routine parameter variables and the task parameter variables for each maneuver, the ER data file is saved on the master computer 422 until such time as the file is transferred to a display module for displaying the ER.

Should the trainer/therapist wish to edit an existing ER, the appropriate user file is opened for read/write operations at 412. Tasks comprising the ER can be deleted, modified, changed in sequence, or added.

In order to download an ER data file from the master computer to a local device, the trainer/therapist connects the master computer to the local device through an appropriate data transfer interface 402, opens the ER data for transfer 409, and sends the data to the local device's memory storage 422. Once the exercise data are stored in the local device, they are accessible for displaying the ER.

4. Details, Embellishments, and Variations a. Architecture and File Structure Considerations The preferred architecture of the local display module will determine the structure of the ER data files. More specifically, if the local display module is implemented with sufficient long-term memory, then the entire catalog of graphics data representing all possible maneuvers is stored in the local data storage component of the device. (301 of FIG. 3) That is, the local display module holds in its non-volatile memory graphics data representing the entire catalog of maneuvers. In this embodiment, the ER data file that is downloaded 409 from the master computer is quite compact because it does not contain the actual graphics data for the maneuvers comprising the ER, but rather a pointer to each maneuver. This compact ER data file is then transferred to the device via a data input/output means 402. The local processor 304 interprets the ER data file, retrieves the proper graphics from local data storage 301 and sends the data to the video and/or audio processors, as appropriate, for output to the video display and speaker, respectively. This configuration is most desirable when one local device will be shared by a number of users, as in a clinic setting, or where the ER data are transferred to the local device during run-time, for instance, by means of a wireless interface with the master computer.

The alternative architecture is a local display module having minimal non-volatile memory. In this case the ER data file that is downloaded from the master computer contains all of the graphics data for each maneuver of a single ER, as well as the paramatized task variables and other control data. Once these data are downloaded, the local device becomes, essentially, personalized for one particular user. Performance data collected during workouts are stored on the module until uploading to the master computer.

b. Auto-Mode and Run-Time Options.

My invention proceeds automatically from one exercise task to the next exercise task, displaying each one seriatim, until the ER is completed as indicated in FIG. 4 at 417. But my invention also anticipates the option of allowing the user to pause after each task until the user indicates she is ready to begin the next task. This is conveniently done by re-setting the pause time (PTime) to some very large value when the user inputs a command to pause. When the user indicates that she is ready to continue, the pause clock is interrupted, PTime is re-set to its initial value and the next task commences. When the pause option is activated, the user's performance data file is altered to so indicate that the ER is not being performed as designed and that the user has not completed an ER according to the parameters set by the trainer. This permits the trainer to adapt the ER as necessary.

The user also has the option of skipping a task in the ER sequence and proceeding to the next task, or to skip forward or backward to some specified task. If the user indicates that she wishes to modify the ER during run-time, the device presents appropriate menus or other input prompts, accepts the user's preferences, modifies the control data according to those preferences and calls the desired exercise task from memory for display.

c. ER Data Download at Runtime.

The above disclosures anticipate downloading the user's ER data from the master computer to the local device prior to beginning a workout. Such downloading is easily effectuated by well known techniques such as CD/DVD devices, USB memory transfer devices, flash cards and the like. In addition, the ER data can be downloaded to the local device by means of various wireless techniques, including RF-based technology such as Wi-Fi® (Wi-Fi is the registered trademark of Wireless Ethernet Compatibility Alliance, Inc., Austin, Tex.) and Bluetooth® (Bluetooth is the registered trademark of Bluetooth Sig. Inc, Bellevue, Wash.). Such wireless data transfer is particularly useful in large clinics where the local devices are mounted on a wall and CD trays etc. are not easily accessed. Once the user is logged onto the system and assigned a local device, the user's exercise data can be wirelessly downloaded from the master computer to that local device. Another alternative is to download ER data through the Internet. This can be done prior to run-time or during the workout.

d. Logging and Analyzing User Performance

As disclosed above, my invention has the capability to log a user's performance and to store and transmit the performance data file. Referring to FIG. 4, once again, one may see that this is accomplished when the user completes her workout 420. Examples of the type of performance data saved include the date of the workout, the specific tasks performed, the number of repetitions completed for each task, the time taken to complete each task, and the pause-time between tasks. These performance data are held in the non-volatile memory 411 of the local display module until analyzed on the local display module or uploaded 423 to master computer 401 by means of the data transfer interface 402. The uploaded data are then stored in the master computer's memory 422. Once the performance data are acquired by the master computer, the trainer/therapist can access and analyze them either manually or through appropriate analysis/graphics software. (Not shown.)

e. User Control Interface Alternatives

As indicated in FIG. 1, a preferred embodiment includes pressure-based keys and keypads 108 for allowing the user to input her preferences for modifying the control data, and hence the manner in which the ER is displayed. There are a number of other options for acquiring user input that are useful in various situations. For instance, well-known remote wireless infra-red (IR) based controls or radio-frequency (RF) based controls are particularly useful when the local device is mounted on a wall out of reach of the user, or where the user is carrying out her exercises at some distance from the display device. Wireless technologies for providing user input capabilities include Wi-Fi® and Bluetooth®. A touch-screen control interface is also anticipated as being within the scope of my invention. As technology advances, a number of new techniques that are not now known will become obvious as alternatives for inputting control commands and data.

f. Cabinet Construction

An important benefit of my invention is that it is small and light enough to be carried from one place to another. Thus, the user who goes on vacation can take the device with her so that she does not miss any scheduled workouts. This benefit is achieved by choosing the materials of construction, particularly the cabinet, to be as strong, durable, and light as possible. I prefer a cabinet that is made of strong molded plastic, as is commonly used in the art, and is reversibly convertible from a closed configuration to an open configuration.

In the embodiment depicted in FIGS. 1 and 2, shows such a cabinet. FIGS. 1 and 2 show the open configuration. Cover-panel 116 is provided that completely covers and protects the display area 118 when the device is in a closed configuration. Top-panel 115 is connected to the top of the case by upper hinge 113, and cover-panel 116 is connected to top-panel 115 by lower hinge 114. Top-panel 114 includes an aperture 117 to accommodate handle 109 when the device is in a closed configuration. Such a stand-alone local display module may incorporate just the display components, or, more practically, incorporate the display components, a data storage media, and a data processing device.

f. The Method of My Invention

This invention also comprises a method for displaying to a user an exercise routine composed of at least one maneuver that is to be performed by the user in a specified manner. My method can be carried out by performing the following steps:

(1) Acquiring graphics data encoding each maneuver to be displayed; (2) Storing the graphics data acquired at step 1 on data storage media; (3) Acquiring control data for each maneuver comprising at least one parameter specifying the manner in which the maneuver is to be displayed; (4) Storing the control data acquired at step 3 on data storage media; (5) Processing the graphics data stored at step 2 and the control data stored in step 4 with a data processor in order to display (i) each maneuver in the manner specified by the control data, and (ii) at least one of the parameters comprising the control data acquired at step 3; and, (6) Displaying (i) each maneuver in a manner specified by the control data and (ii) at least one of the parameters comprising the control data.

The foregoing method may be modified by the additional steps of: (7) Acquiring from the user the user's preferences for modifying the control data stored at step 4; (8) Modifying the control data stored at step 4 according to the user's preferences acquired at step 7; and, (9) Storing the control data modified at step 8 by replacing the control data stored at step 4, whereby each maneuver displayed at step 6 will be displayed in a manner specified by the control data as modified at step 8.

The foregoing steps are not necessarily performed in the order given; however, the graphics data are generally acquired first and then the control data for each maneuver are acquired. From the disclosures made above it will be readily appreciated that "the parameter[s] specifying the manner in which the maneuver is to be displayed" include, inter alia, the number of repetitions of each maneuver that will be displayed and the sequence in which the maneuvers will be displayed.

5. Summary

From the foregoing description of the various preferred embodiments of my invention, the novelty, utility, means of constructing, and means of using my invention will be readily apprehended. However, the foregoing description merely represents the best mode known to me as of the present date. The embodiments herein disclosed are not meant to be exclusive of other ways of making and using my invention, and it will be obvious to those of skill in the field that other means of producing and/or using my invention lie within the scope of this disclosure and the claims, below. It is to be understood that my invention is not limited to the embodiment disclosed above but encompasses any and all embodiments within the scope of the following claims.

I claim:

1. A display system for displaying an exercise routine to a user, wherein the exercise routine comprises one or more exercise tasks, and wherein each of the exercise tasks specifies how the user is to perform a maneuver, said display system comprising, in combination:

(a) a maneuver display;

(b) a cabinet housing said maneuver display;

(c) a data processor, and, (d) data storage media accessible by said data processor, wherein said data storage media have stored thereon exercise routine data, and wherein said exercise routine data comprise:

(i) graphics data representing each maneuver; and, (ii) one or more task parameters, wherein said task parameters include at least one of: number of total repetitions of the maneuver to be performed, pause-time between repetitions, cadence, hold-time, task duration, and task rate, wherein said data processor is configured to display on said maneuver display said graphics data according to said task parameters stored on said data storage media.

2. The display system of claim 1 wherein said exercise routine data further comprise a task identifier.

3. The display system of claim 1 further comprising a task parameter display, wherein at least one of said task parameters stored on said data Storage media is displayed on said task parameter display.

4. The display system of claim 1 wherein said exercise routine data stored on said data storage media further comprise one or more routine parameters, wherein said routine parameters include at least one of: a user identifier, inter-task pause-time, total routine duration, and task sequence.

5. The display system of claim 4 further comprising a routine parameter display, wherein at least one of said routine parameters stored on said data storage media is displayed by said routine parameter display.

6. The display system of claim 1 further comprising:

(a) a master computer adapted to perform at least one of: designing the exercise routine, creating the exercise routine data, and storing said exercise routine data; and, (b) means for downloading said exercise routine data to said data storage media.

7. The display system of claim 1 wherein said data processor is adapted to display the exercise tasks seriatim in a predetermined sequence.

8. The display system of claim 1 wherein said maneuver display, said cabinet, said data storage media, and said data processor are combined in a stand-alone local display module.

9. The display system of claim 8 further comprising:

(a) a master computer adapted to perform at least one of: designing the exercise routine, creating said exercise routine data, and storing said exercise routine data; and, (b) means of downloading said exercise routine data to said local display module.

10. The display system of claim 1 further comprising at least one user control input device in communication with said data processor, wherein the user uses said control input device for modifying said exercise routine data.

11. The display system of claim 10 wherein said user control input device is chosen from the group consisting of: pressure-based keys, keypads, touch-screen controls, infrared based controls, and radio-frequency (RF) based controls.

12. The display system of claim 1 further comprising:

(a) said data storage media containing performance data; and, (b) a data processor adapted to access the performance data contained on said storage media in order to analyze or display said performance data.

13. The display system of claim 1 wherein said data storage media further have stored thereon audio data representing the task parameters stored on said data storage media.

14. A method of displaying an exercise routine to a user, wherein the exercise routine comprises one or more exercise tasks, and wherein each of said exercise tasks specifies how the user is to perform a maneuver, said method comprising the steps of:

(33a) storing on computer accessible data storage media graphics data encoding the maneuver, (33b) storing on computer accessible data storage media one or more task parameters, wherein said task parameters include at least one of: number of total repetitions of the maneuver to be performed, pause-time between repetitions, cadence, hold-time, task duration, and task rate;

(33c) processing the graphics data stored at Step (33a) according to the task parameters stored at Step (33b); and, (33d) displaying the graphics data processed at Step (33c).

15. The method of claim 14 further comprising the step of displaying at least one of the task parameters stored at Step (33b).

16. The method of claim 14 wherein Step (33d) is performed by displaying the tasks seriatim according to a predetermined sequence.

17. The method of claim 14 further comprising the steps of:

(36a) acquiring one or more preferences of the user for displaying the exercise routine; and, (36b) modifying the task parameters stored at Step (33b) according to the user's one or more preferences acquired at Step (36a), whereby Step (33d) is performed in a manner specified by the task parameters as modified at Step (36b).

18. The method of claim 14 further comprising the steps of:

(37a) acquiring performance data representative of the user's performance; and, (37b) storing the performance data acquired at Step (36a) on data storage media.

19. The method of claim 18 comprising the further steps of (38a) accessing the performance data stored a Step (37b); and, (38b) designing an exercise routine using the performance data accessed at Step (38a).

20. The method of claim 14 further comprising the step of displaying on a display a countdown of the number of repetitions yet to be performed.

* * * * *